United States Patent [19]

Lerner

[11] 4,087,717

[45] May 2, 1978

[54] COLOR CATHODE RAY TUBE HAVING LAMINAR FLOW PROMOTING STUDS IN FACEPLATE CORNERS

[75] Inventor: Martin L. Lerner, Riverforest, Ill.

[73] Assignee: Zenith Radio Corporation, Glenview, Ill.

[21] Appl. No.: 779,439

[22] Filed: Mar. 21, 1977

[51] Int. Cl.[2] ..... H01J 29/07; H01J 29/02

[52] U.S. Cl. ..... 313/406; 220/2.1 A

[58] Field of Search ..... 313/406, 407, 404, 405

[56] References Cited

U.S. PATENT DOCUMENTS

| | | | |
|---|---|---|---|
| 3,890,526 | 6/1975 | Palac | 313/404 X |
| 3,986,072 | 10/1976 | Adamski | 313/404 |

*Primary Examiner*—Robert Segal

*Attorney, Agent, or Firm*—Ralph E. Clarke

[57] ABSTRACT

This disclosure depicts a color cathode ray tube including a shadow mask and improved suspension means for suspending the mask adjacent to the flangeless faceplate of the tube. The improved suspension means comprises a plurality of metal studs spaced about the periphery of the shadow mask assembly and outside the viewing area of the faceplate. The studs are characterized by having an intermediate part which has in its cross-section a non-circular profile tapering gradually in a radially inwardly direction to a blunt extremity so as to present to radially out-rushing screening fluid an initially narrow, gradually expanding profile which promotes laminar flow of screening fluid around the stud during the radial flow suffusion process. The effect is to inhibit screening fluid wash back and consequent formation of permanent, visible wave patterns in the coating upon drying.

4 Claims, 14 Drawing Figures

COLOR CATHODE RAY TUBE HAVING LAMINAR FLOW PROMOTING STUDS IN FACEPLATE CORNERS

CROSS REFERENCE TO RELATED PATENT APPLICATION

This application is related to but in no way dependent upon the following copending application of common ownership herewith assigned: Ser. No. 592,431, filed July 2, 1975.

BACKGROUND OF THE INVENTION

This invention relates generally to color cathode ray tubes of the type having a shadow mask, and more particularly to structures for suspending a shadow mask in a color tube. The invention is especially concerned with an improved configuration of the stud comprising part of each of a plurality of mask suspension devices.

Conventional color cathode ray tubes have a glass envelope which comprises a flanged front panel sealed to a funnel. A shadow mask is supported adjacent to a phosphor screen pattern deposited on the inner surface of a faceplate portion of the front panel. The mask is supported on studs embedded in the inner surface of the front panel flange.

Proper tube operation requires that the shadow mask be suspended at a precise distance from the phosphor screen pattern and at a precise orientation relative thereto. Proper tube operation also requires that the phosphor screen pattern and the aperture pattern in the associated shadow mask be aligned with respect to the effective source of the electron beams in the assembled tube in the same way that they were aligned with respect to an effective point light source used to screen the phosphor pattern on the faceplate. If this corresponding relative alignment is not established, color purity errors will appear in the images displayed by the end-product tube.

This invention is especially useful when embodied in a novel type of shadow mask color tube, a portion of which is shown by FIG. 1. This novel tube 10 has a substantially rectangular, flangeless faceplate 12 on the inner surface of which is suspended a substantially rectangular shadow mask assembly 14. Shadow mask assembly 14 is illustrated as being of a low-cost, light weight, frameless, flexible character, being preferably formed integrally from a single sheet of electrically conductive material such as steel, all as described in detail and claimed in U.S. Pat. No. 3,912,963 assigned to the assignee of this invention.

Shadow mask assembly 14 is supported by four suspension devices, one at each corner of the mask. One such suspension device is indicated by 16. Suspension device 16 is comprised, in the illustrated embodiment, of a two-legged bracket 17 attached to a skirt 18 of shadow mask 14. Bracket 17, and the shadow mask assembly 14 it suspends are detachably engaged through spring 20 and lug 22 to stud 24. Stud 24 is embedded in the glass of faceplate 12. This suspension system is described in U.S. Pat. No. 3,890,526 assigned to the assignee of this invention.

This suspension arrangement has a number of unique requirements which are not imposed on conventional mask suspension systems. One of these requirements, and one which is the subject of this invention, is that any component of the suspension device which might be affixed in or to the phosphor-inner surface of faceplate 12 must not intrude upon the image area of the faceplate, nor interfere with faceplate screening operations. Interference with faceplate screening operations is illustrated by FIG. 2. Prior to screening, shadow mask assembly 14 is detached from faceplate 12. As illustrated, a plurality of metal studs 24, which are shown as being relatively flat with a cross-section of substantially greater width than thickness, remain embedded in faceplate 12. Several applications of screening fluids including three applications of phosphor screening fluids are normally required with each phosphor application comprising a mixture of one of the three primary color phosphors such as red, green, or blue, together with a photoresist sensitizing agent and an organic binder. Such a phosphor screening fluid is commonly referred to as a "slurry". To apply a screening fluid by using the radial flow suffusion process, faceplate 12 is rotated as the screening fluid is poured on the faceplate at the center area 13. As the faceplate 12 rotates, the fluid spreads to the edges of the panel and excess fluid is cast off from faceplate 12 by centrifugal force. For a more detailed description of such a process, see copending application Ser. No. 592,431 filed July 2, 1975.

As shown by FIG. 2, the free flow of the screening fluid may be intercepted, however, by the plurality of corner-located studs 24, whose flattish faces act to dam the flow. As a result, the radially out-rushing flow of screening fluid, indicated schematically by lines 26, "washes back," resulting in wave patterns 28 which tend to remain and be fixed as the screening fluid is dried by air and applied heat. The effect of this resulting non-uniformity in phosphor density is cumulative as faceplate 12 is successively screened by the application of other screening fluids. The wave patterns 28, which occur at all four corners of faceplate 12, are visible to the viewer.

A typical wave pattern 28 (considerably exaggerated for exemplary purposes) is shown in cross-section by FIG. 3. The radially out-rushing flow of screening fluid 26 in response to centrifugal force is shown by arrow 27. Upon contact with stud 24, the flow washes back into the image area, forming wave pattern 28. As each coating of screening fluid is applied, a progressive build-up of wave patterns 28 occurs. The deleterious effects of these wave patterns are three-fold. First, the thickened coatings are visible to the viewer as dark areas in the corners of the screen; second, cross-contamination of the color occurs; and third, under-exposure in the thickened area during the printing process results in non-adherence of the phosphor and consequent phosphor wash-off and flake-off.

An approach to resolving the problem of screening fluid washback during screening is shown by the configuration of stud 30 in FIG. 4. The provision of the legs 32 and 34 elevate the face 36 of stud 30. During screening of the faceplate, the screening fluid is suffused across the inner surface of the faceplate, passes between and around the legs 32 and 34 as shown by flow lines 38, and hence does not wash back onto the image area to cause visible wave patterns.

Another stud configuration (not shown) capable of inhibiting washback comprises a plurality of slender legs embedded in the faceplate, and supporting a bracket suspension means. This multi-legged configuration is considered impractical, however, in view of the difficulty in cleaning surplus, unattached screening fluid particles from between the legs. Such particles become loose and can migrate to gun electrode and cathode parts to cause arcing and emission problems.

Support studs having circular profiles have been commonly used to support shadow mask assembly in tubes having the conventional flanged faceplate. Such studs are embedded in the flange as shown, for example, by FIG. 3 of U.S. Pat. No. 3,005,921. In this flange location, the stud does not intrude upon the image area of the faceplate nor interfere with faceplate screening operations. If a stud of circular profile were embedded in the faceplate, however, the bluntness of the circular profile could result in appreciable washback, the effect of which could be visible to the viewer.

OBJECTS OF THE INVENTION

It is an object of this invention to provide, especially in a color tube of a novel type having a flangeless faceplate, an improved mask suspension system.

It is an especially important object of this invention to provide an improved configuration of the studs comprising a part of the mask suspension system wherein washback of the screening fluids onto the viewing area of the faceplate during the faceplate screening process is inhibited.

BRIEF DESCRIPTION OF THE DRAWINGS

The features of the invention which are believed to be novel are set forth with particularity in the appended claims. The invention, together with further objects and advantages thereof, may best be understood, however, by reference to the following description taken in conjunction with accompanying drawings, and in which:

FIG. 9A is an end view of the profile taken along lines 9A—9A of FIG. 9, while

DESCRIPTION OF THE PREFERRED EMBODIMENT

The present invention is concerned with a novel stud for use in a color cathode ray tube having a substantially rectangular, flangeless faceplate. The inner surface of this faceplate is adapted to receive by a radial flow suffusion process at least one coating of a phosphor-bearing, air-drying screening fluid. The color cathode ray tube has a substantially rectangular shadow mask assembly suspended adjacent to the faceplate by a plurality of the novel metal studs spaced about the periphery of the shadow mask assembly and outside the viewing area of the faceplate.

Figure 1:
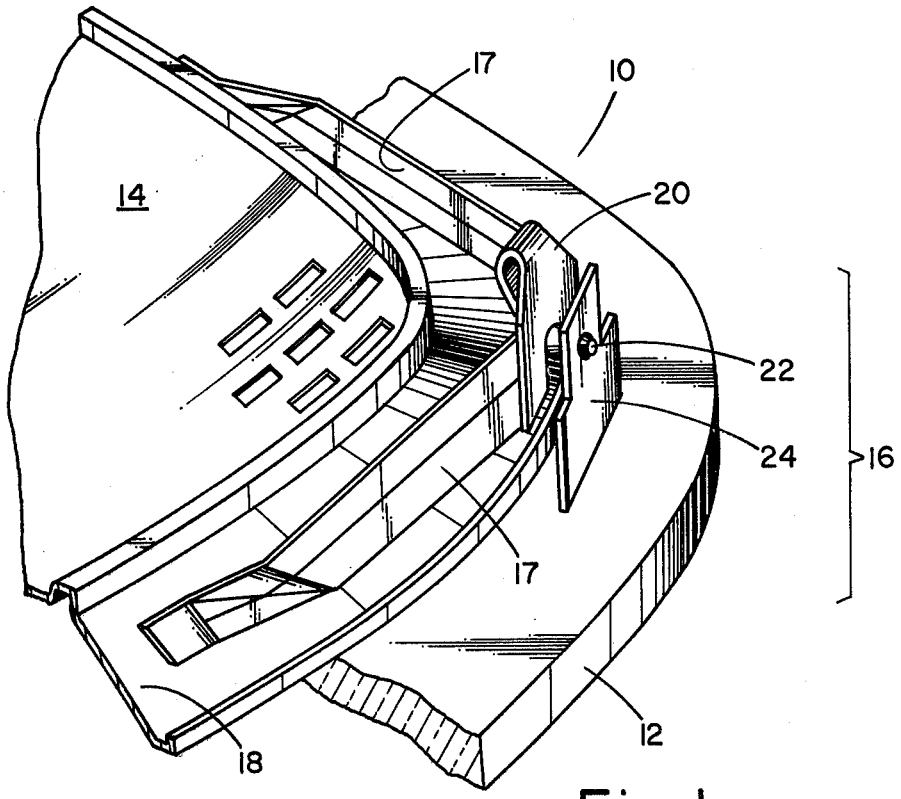
Fig. 1 PRIOR ART
FIG. 1 is a fragmentary perspective view of a corner of a color cathode ray tube having a flangeless faceplate, and a section of a shadow mask for the tube together with a suspension device for suspending the shadow mask adjacent to the faceplate of the tube, according to the prior art.
Figure 2:
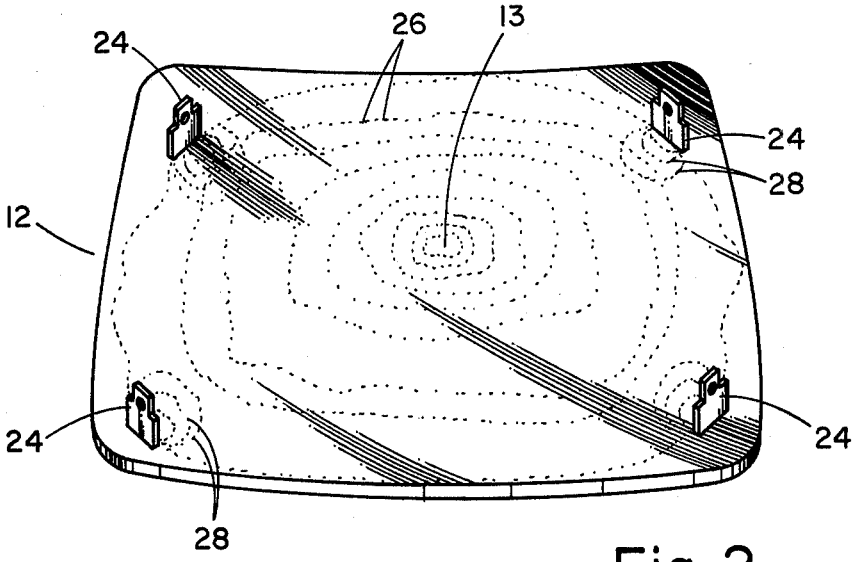
Fig. 2 PRIOR ART
FIG. 2 is a perspective view of the inner surface of a cathode ray tube faceplate during the screening operation, showing four embedded studs comprising part of the shadow mask suspension device shown in FIG. 1, and the effects of screening fluid wash back.
Figure 3:
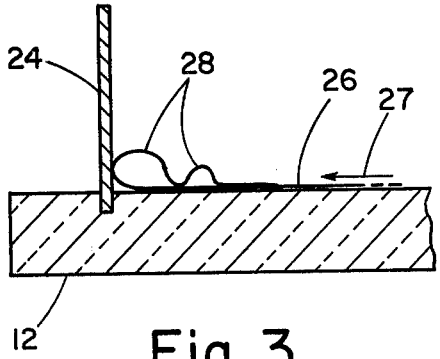
Fig. 3 PRIOR ART
FIG. 3 is a side view in cross-section of a stud embedded in a faceplate showing in greater detail the formation of visible wave patterns resulting from the wash back of the out-rushing screening fluids.
Figure 4:
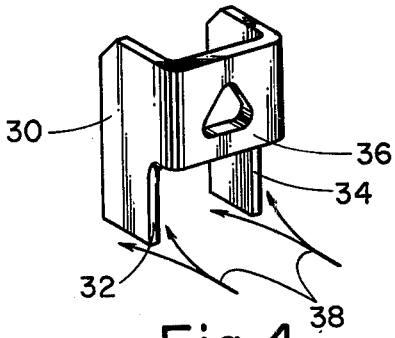
Fig. 4 PRIOR ART
FIG. 4 is an isolated front elevational view of a prior art stud shown the provision of two supporting legs.
Figure 5:
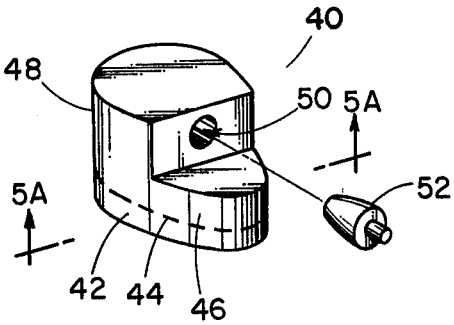
FIG. 5 is a view in perspective of a stud according to an embodiment of this invention having a cross-section in profile which is egg-shaped.
Figure 5A:
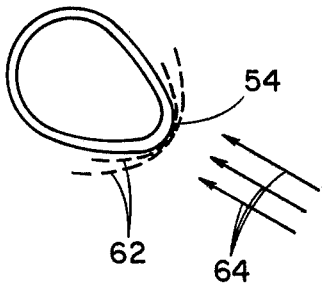
FIG. 5A is an end view in section taken along lines 5A—5A of FIG. 5.

FIGS. 5 and 5A illustrate an embodiment of the invention comprising a shadow mask-suspending stud 40. Stud 40 has a part 42 which is embedded in the glass of the flangeless faceplate of the cathode ray tube usually to the depth of about one-eighth of an inch, with the approximate depth being indicated by broken line 44. Stud 40 also has an intermediate section 46 which is not embedded in the glass of the faceplate, and a distal end 48 for detachably engaging the shadow mask assembly. Distal end 48 of stud 40 is shown as having an aperture 50 for receiving lug 52 which comprises a part of one type of attaching means for the shadow mask bracket assembly (not shown).

The process of embedding a stud such as that shown by 40 in the glass of a faceplate is well known in the art. The process, in simple summary, comprises fixturing the stud in relation to associated studs disposed about the periphery of the faceplate, heating the studs and the glass of the faceplate to a predetermined temperature, and pressing the studs into the glass a predetermined distance.

FIG. 5A shows an end view the non-circular profile of the intermediate section 46 of stud 40 tapering gradually to a blunt extremity 54. It will be noted that this non-circular profile has essentially in cross-section a profile which is egg-shaped.

Figure 6:
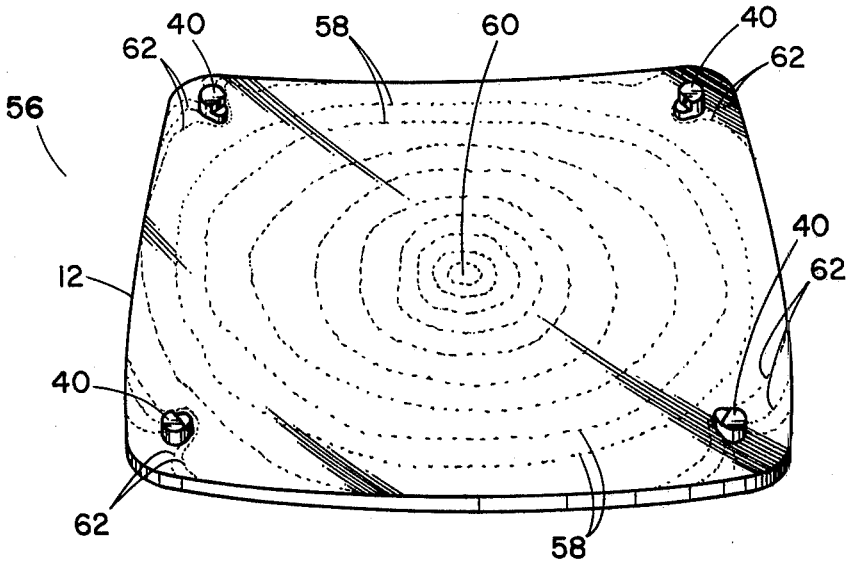
FIG. 6 is a perspective view of the inner surface of a cathode ray tube during the screening operation, and the effect of four studs according to this invention on this screening operation.

FIG. 6 illustrates a plurality of studs 40 according to this invention as being installed in a substantially rectangular, flangeless faceplate 56. The studs are spaced about the periphery of the shadow mask assembly (not shown) and outside the viewing area of faceplate 56. Faceplate 56 is adapted to receive by a radial flow suffusion process at least one coating of a phosphor-bearing, air-drying screening fluid indicated by lines 58, in conformance with recognized practice. The screening fluid is applied at the approximate center area 60 of faceplate 56. As faceplate 56 is rotated, the radially out-rushing screening fluid, urged by centrifugal force, comes into contact with studs 40. The non-circular profile of the intermediate part of studs 40, tapers gradually in a radially inward direction to a blunt extremity, and presents to the radially out-rushing screening fluid an initially narrow, gradually expanding profile which promotes the laminar flow 62 of the screening fluid around studs 40 during the radial flow suffusion process. As shown by the laminar flow lines 62 around each of the studs 40, washback of the screening fluid is inhibited, and as a consequence, the formation of permanent, visible wave patterns in the coating upon drying is inhibited. It will be noted that the narrowest end of the egg-shaped studs 40 are radially inwardly directed in their location on faceplate 56. The effect is shown in greater detail by reference again to FIG. 5A wherein the flow of screening fluids (shown by FIG. 6) is indicated by arrows 64, and the laminar flow of the screening fluid around stud 40 is indicated by lines 62.

Figure 7:
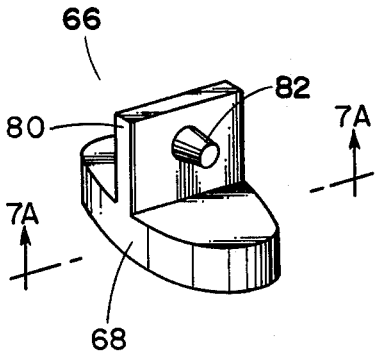
FIG. 7 is a view in perspective of another embodiment according to this invention having in cross-section a profile in the form of an ellipse.
Figure 7A:
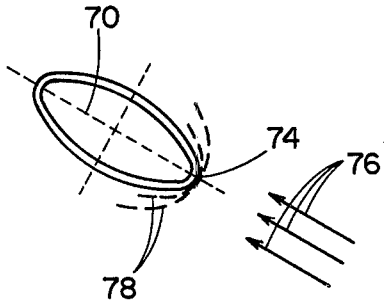
FIG. 7A is an end view in section taken along line 7A—7A of FIG. 7.

Another form factor of the embodiment which promotes the laminar flow of the screening fluid around the stud according to this invention, is shown by stud 66 illustrated in FIGS. 7 and 7A. The intermediate part 68 of stud 66 has in cross-section a non-circular profile in the form of an ellipse whose major axis 70 is oriented radially that is, oriented toward the center area of the faceplate. The blunt extremity 74 of stud 66, as shown by FIG. 7A, presents to the radially out-rushing screening fluid, indicated by arrows 76, an initially narrow, gradually extending profile which promotes the laminar flow of the screening fluid, as indicated by laminar flow lines 78. The result is the inhibition of the screening fluid washback and the inhibition of consequent formation of permanent, visible wave patterns in the coating upon drying.

The distal end 80 of stud 66 is illustrated as comprising another common type of shadow mask suspension system, wherein the lug 82 is shown as being an integral part of distal end 80 of stud 66 to detachably engage an aperture in the shadow mask assembly (not shown).

Figure 8:
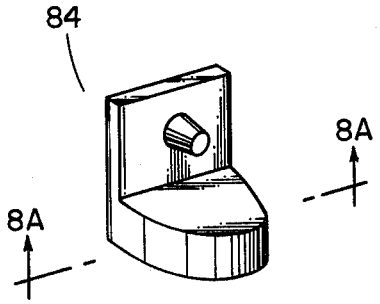
FIG. 8 is another view of the FIG. 7 stud configuration except that the stud is truncated to provide an effectively shorter stud.
Figure 8A:
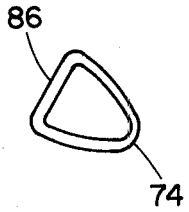
FIG. 8A is an end view in section taken along lines 8A—8A of FIG. 8.

FIGS. 8 and 8A represent another embodiment of the invention shown by FIG. 7. Suspending a shadow mask on a flangeless faceplate makes it mandatory that the stud be not over-long in the radial direction so as to cause the stud and/or the shadow mask support system to intrude into the viewing area. As a result, stud 84 is shown as being truncated on the major axis to provide a stud having the radially inwardly directed blunt extremity of stud 84, but wherein the major axial length is reduced by substantially one-half. It will be noted that the truncated section is not sharply cut off, but preferably has a corner-rounded profile 86 to inhibit glass-checking and cracking which might otherwise be caused by sharp stud corners.

Figure 9:
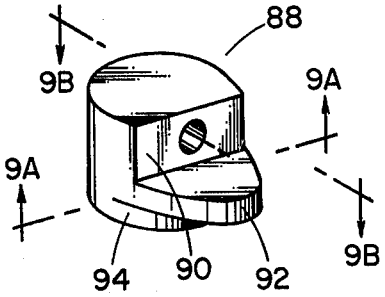
FIG. 9 is a view in perspective representing another embodiment of this invention wherein an intermediate stud part has in cross-section a profile which is egg-shaped and a base section for embedment in the faceplate which is circular.
Figure 9A:
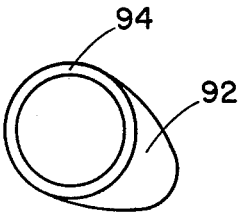
Figure 9B:
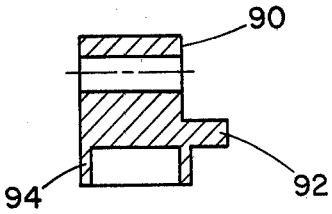
FIG. 9B is another view in section taken along lines 9B—9B of the FIG. 9 embodiment.

FIG. 9 shows another embodiment wherein the distal end 90 of stud 88 and intermediate part 92 are identical, respectively, to distal end 48 and intermediate part 46 of the stud 40 shown by FIG. 5. However, in this embodiment, the embedded part 94 is shown as being circular in profile, as shown in end view by FIG. 9A, and in cross-section by FIG. 9B. While end section 94 is made circular to facilitate embedment in the faceplate, intermediate section 92 has in cross-section a non-circular profile which is egg-shaped, with the narrowest end of the egg-shape radially inwardly directed, as shown by the aforedescribed stud 48 of FIG. 5.

It will be noted that the end views of the studs representing the embodiments; that is, views 5A, 7A, 8A, and 9A and 9B, show the nether part of the studs embedded in the inner surface of the faceplate as being hollow in configuration. The hollow configuration is deemed to be preferable in that it increases the area of hot-melt attachment between the studs and the faceplate.

The studs according to this invention may be manufactured by any of several well-known methods including cold heading, machining, or forging. With regard to material, the studs may be composed of, for example, number 446 stainless steel.

The invention is not limited to the particular details of construction of the embodiment depicted, and other modifications and applications are contemplated. For example, whereas the suspension device as illustrated have been shown as having a particular construction, the principles of this invention can be employed to provide studs having other configurations and studs useful in other types of suspension devices. Other changes may be made in the above-described apparatus without departing from the true spirit and scope of the invention herein involved, and it is intended that the subject matter in the above depiction shall be interpreted as illustrative and not in a limiting sense.

I claim:

1. For use in a color cathode ray tube having a substantially rectangular, flangeless faceplate, the inner surface of which is adapted to receive by a radial flow suffusion process at least one coating of a phosphor-bearing, air-drying screening fluid, and having a substantially rectangular shadow mask assembly suspended adjacent to said faceplate by a plurality of metal studs spaced about the periphery of said shadow mask assembly and outside the viewing area of said faceplate, with a part of each of said studs embedded in said inner surface of said faceplate and with the distal end of each detachably engaged to said shadow mask assembly, said studs each being characterized by having an intermediate part between the embedded part and said distal end which has in its cross-section a non-circular profile tapering gradually in a radially inward direction to a blunt extremity so as to present to radially out-rushing screening fluid an initially narrow, gradually expanding profile which promotes laminar flow of said screening fluid around said stud during said radial flow suffusion process to inhibit screening fluid washback and consequent formation of permanent, visible wave patterns in said coating upon drying.

2. The stud defined by claim 1 wherein said intermediate part has in cross-section a profile which is egg-shaped, with the narrowest end of said egg-shape radially inwardly directed.

3. The stud defined by claim 1 wherein said intermediate part has in cross-section a profile in the form of an ellipse whose major axis is oriented radially.

4. For use in a color cathode ray tube having a substantially rectangular, flangeless faceplate, the inner surface of which is adapted to receive by a radial flow suffusion process at least one coating of a phosphor-bearing, air-drying screening fluid, and having a substantially rectangular shadow mask assembly suspended adjacent to said faceplate by a plurality of metal studs spaced about the periphery of said shadow mask assembly and outside the viewing area of said faceplate, with a part of each of said studs embedded in said inner surface of said faceplate and with the distal end of each detachably engaged to said shadow mask assembly, said studs each being characterized by having an intermediate part between the embedded part and said distal end which has in cross-section a profile in the form of an ellipse whose major axis is oriented radially so as to present to the radially out-rushing screening fluid an initially narrow, gradually expanding profile which promotes laminar flow of said screening fluid around said stud during said radial flow suffusion process to inhibit screening fluid washback and consequent formation of permanent, visible wave patterns in said coating upon drying.

* * * * *